United States Patent [19]

Lee

[11] 4,010,949

[45] Mar. 8, 1977

[54] PLUGS FOR POCKET BILLIARD TABLES

[76] Inventor: A. George Lee, 4103 Elmhurst, Royal Oak, Mich. 48073

[22] Filed: June 30, 1975

[21] Appl. No.: 591,454

[52] U.S. Cl. ..... 273/4 A; 273/14

[51] Int. Cl.[2] ..... A63D 15/00

[58] Field of Search ..... 273/4, 12, 14, 8, 9

[56] References Cited

UNITED STATES PATENTS

| | | | |
|---|---|---|---|
| 23,458 | 4/1859 | Fedderke | 273/4 A |
| 241,943 | 5/1881 | Dockstader | 273/4 A |
| 980,142 | 12/1910 | Byner | 273/4 A |
| 1,115,761 | 11/1914 | Adler | 273/9 |

*Primary Examiner*—Paul E. Shapiro
*Attorney, Agent, or Firm*—Irvin L. Groh

[57] ABSTRACT

Pocket plug assemblies for converting a pocket billiard table to a carom billiard table and to a snooker pool table in which the plug has a cushion rail portion supported from the permanent rail portion of the table in a manner positioning the ball engaging edges of the rail portions in alignment with the ball engaging edge of the permanent rails and so that the impact of a ball striking the cushion rail portions of the plug is absorbed by the permanent rail portions of the table.

4 Claims, 11 Drawing Figures

PLUGS FOR POCKET BILLIARD TABLES

This invention relates to billiard tables and more particularly to a plug arrangement for converting the pockets of a pocket billiard table to the play of carom billiards or snooker.

For converting pocket billiard tables for the play of carom billiards or for the play of snooker, it is necessary to modify the pockets. For carom billiards, it is necessary to entirely plug the pockets to afford a continuous ball engaging cushion around the perimeter of the table and in the case of snooker, the size of the pockets must be reduced and modified. In making such a modification, it is important that the modified areas afford a cushion portion having the same properties and characteristics as the permanent cushion portion of the table. Such characteristics and properties inlcude maintaining the ball engaging area or cushion edge of the pocket plug assemblies at the same table height as the cushion edge of the permanent cushion portions of the table. Also, the cushion edge portions must be maintained in longitudinal alignment with each other and the plug assemblies must be secured in position in a manner so that impact of a ball striking the plug assembly is absorbed in the same manner as it would be by the original or permanent cushion of the table.

Prior art devices have attempted to provide plug assemblies for pocket billiard tables but such devices are unduly complicated and expensive in their attempts to provide arrangements that can be fitted to accommodate variations in pocket dimensions which for many tables may vary slightly from each other in spite of the manufacturers attempt at uniformity. Also, it is important that once the pocket plug assemblies are installed that they can be easily removed and reinstalled without the necessity of making a multiplicity of adjustments. Also, prior art devices require separate arrangements for each style or type of table, depending on the manufacturer. The prior art devices completely plug the pockets and no attempt is made to provide for reducing the size of the pockets for the play of the game of snooker, which is a form of pocket billiards employing both numbered and unnumbered balls of smaller size than used in conventional pocket billiards.

It is an object of the invention to provide pocket plugs for converting the pockets of a pocket billiard table for the play of carom billiards or snooker in which the pocket plugs offer the same ball contact and load absorbing characteristics as the permanent ball contacting rail portions of a pocket billiard table.

It is another object of the invention to provide pocket plug assemblies for converting a pocket billiard table to a carom billiard or to a snooker table in which the pocket plug assemblies are supported relative to the table in a manner insuring alignment of the plug assemblies with the adjacent permanent table portions and in which impact of balls striking the plug assemblies is transmitted to the permanent cushion rails of the table.

Still another object of the invention is to provide pocket plug assemblies for converting a pocket billiard table for the play of carom billiards or snooker in which the plug assemblies may be fitted to the pockets to accommodate variations in the dimensions in the pockets and the permanent rails of the table.

Pocket plug assemblies for converting a pocket billiard table to a carom billiard or snooker table are provided in which the plug assemblies for converting to the play of carom billiards by completely filling the side pockets, may be readily cut to tightly fit the side pockets and in which the plug assemblies for the end pockets may be readily adjusted to tightly fit and fill the pocket. In converting for the play of snooker, the size of the pockets is reduced. In both cases, the plug assemblies are supported from the adjacent permanent rail assemblies of the table in a manner positioning the ball engaging portions of the plug assemblies so that the impact of a ball striking the plug assemblies is transmitted to the permanet rail assemblies in a manner giving the plug assemblies the same characteristics as the permanent rail portions of the table.

Figure 1:
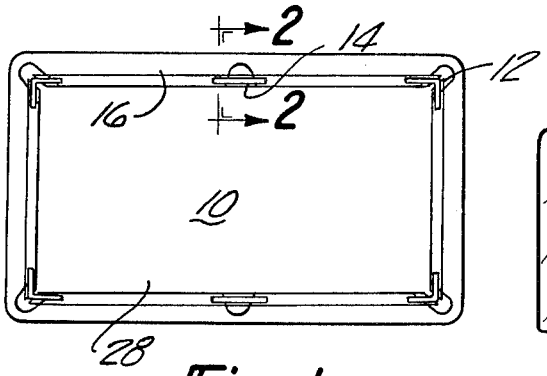
FIG. 1 is a top view of a conventional pocket billiard table.
Figure 2:
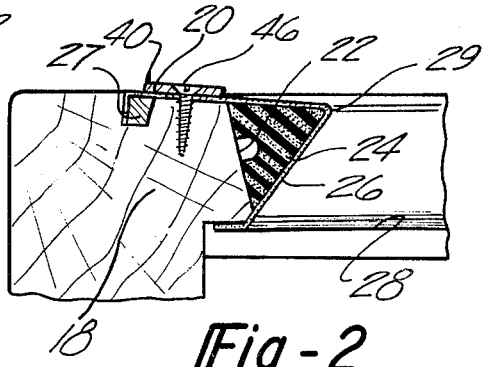
FIG. 2 is a cross-sectional view at an enlarged scale taken generally on line 2—2 in FIG. 1 illustrating the construction of the permanent rail portions of the table.
Figure 3:
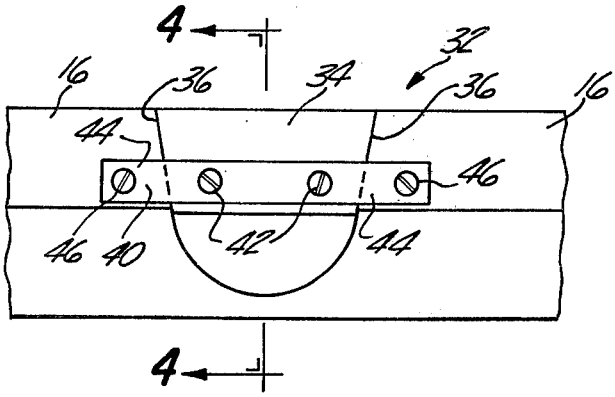
FIG. 3 is a top view of a plug assembly embodying the invention installed in a side pocket of a pocket billiard table for the play of carom billiards.

Referring to FIG. 1, conventional pocket billiard tables 10 are generally rectangular and include four corner pockets 12 and a pair of facing side pockets 14 for receiving billiard balls. The table is provided with a cushion or rail assembly 16 around the entire perimeter of the table which is interrupted by the pockets 12 and 14. The permanent rail assemblies 16, as best seen in FIG. 2, are usually formed by a solid support portion 18 made of wood having an upper surface 20 and a beveled surface 22 to which a cushion 24 of rubber or like material and often having a triangular cross section is fastened by means of an adhesive. The cushion portion 24 as well as the upper surface 20 of the support portion 18 are covered with a felt cloth material indicated at 26 and of the same type as covering the hard flat playing surface 28 of the table. The cloth may be held in place by a cleat 27 at one edge and by tacks or the like (not shown) at the other edge. The rail assemblies are detachably connected by means not shown to the top of the table so that the rail assemblies are disposed with their top surfaces at a slight angle converging toward the playing surface 28 and so that one corner of the covered cushion 24 forms a cushion edge or lip 29 disposed at a uniform height above the playing surface 28. The lip 29 is disposed at a height above the table top slightly greater than the radius of the billiard balls used on the table. As a result, the centers of the balls are below the lip 29 which for discussion purposes may be considered the ball engaging edge.

To convert the table 10 from a pocket billiard table to a carom billiard table, it is necessary that the rails 16 be continuous around the perimeter of the table without interruption by the openings of the pockets 12 and 14. To make such a conversion, the pockets 12 and 14 are completely filled with plug assemblies 30 and 32 respectively, to prevent balls from entering the pockets.

Figure 4:
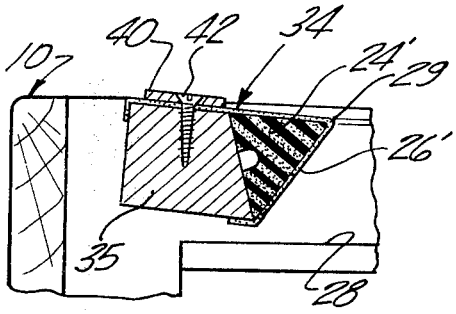
FIG. 4 is a cross-sectional view similar to FIG. 2, taken on line 4—4 in FIG. 3.

The plug assemblies 32, which are adapted for use with the pair of side pockets 14 of the table 10, each include a rail portion 34 having a cross-sectional construction configuration similar to the upper portion of the permanent rail 16 of the table 10. The rail portion 34 includes a solid wooden support portion 35 having a beveled surface 22' similar to bevel surface 22 on the support portion 18 and a cushion portion 24' which is of a similar triangular cross section as the cushion portion 24 of the permanent rail 16. The rail portion 34 is covered with felt material 26' as seen in FIG. 4, to form a ball engaging edge or lip 29'. The ends 36 of the rail portion 34 are formed at an angle to conform to the angular ends of the permanent rail 16 at opposite sides of the side pockets 14. An elongated bracket member 40 bridges the side pocket 14 and is fastened to the top of the rail portion 34 by means of wood screws 42 passing through the bracket 40 and into the support portion 35 of the plug 32. Opposite end portions 44 of the bracket 40 rest on top of the permanent rail 16 at opposite sides of the pockets 14 and are provided with openings to receive wood screws 46 which pass through the bracket 40 and into the wood support portion 18 of the permanent rail 16 of the table.

In actual practice, the rail portions 34 are furnished to the user in a length greater than the width of the side pockets 14 and without the cloth material 26' applied. To install the plug assemblies 32, it is simply necessary to cut the excess material from the ends of the rail portions 34 at an angle conforming to the angular ends of the permanent rails 16 adjacent to the pockets 14. Thereafter the rail portions are covered with felt 26' and the brackets 40 are attached. With the parts in alignment and in place in the pockets 14, the location of holes in the permanent rails 16 are marked and formed for receiving screws 46. The plug assembly 32 is then ready for connection to the permanent rail portions 16 of the table by means of the screws 46. This makes it possible to fit each of the side pockets 14 with a separate plug assembly 32 and after the installation is made the plugs 32 are carefully marked so that they may be replaced in association with the correct side pocket 14, after they have been removed for use of the table as a pocket billiard table.

It will be noted that the support portion 35 has a smaller vertical dimension than the support portion 18 of the permanent rails 16. Consequently, with the plug 34 in position in a side pocket 14, the bracket element 40 serves to support the rail portion 34 directly from the permanent rail 16 and in slightly elevated position relative to the playing surface 28. When the ball engaging lip 29' of the plug element 34 is struck by a billiard ball, the impact is absorbed by the cushion portion 24' and is transmitted through support 35 and the bracket 40 to the permanent rail 16 of the table.

Figure 11:
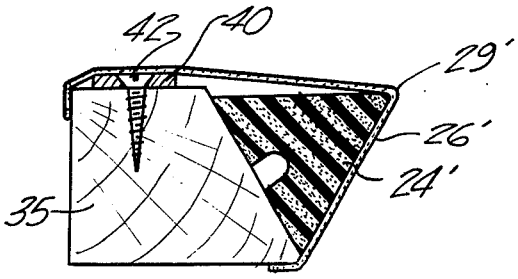
FIG. 11 is a view similar to FIG. 4 showing an alternate form of plug assembly.

If desired, the bracket member 40 may be attached in direct contact to the support portion 35, as shown in FIG. 11 and thereafter, the cover material 26' may be applied in the usual fashion to cover not only the support portion 35, and cushion portion 24' but also to be disposed over the top of the bracket 40. This makes it possible for the cloth material 26' to conceal the bracket 40 and the screws 42. In this instance, the rail portions 34 are formed so that the cushion portion 24' has its upper surface disposed slightly below the upper surface of the support section 35. This is for the purpose of accommodating the thickness of the felt covering material since the bracket 40 is in direct contact with the support portion 35 of the plug assembly 32 and rests on top of the cloth material 26 of the permanent rail section 16.

Referring now to the plug assembly 30 which is used in association with the corner pockets 12, each of the corner plug assemblies includes a pair of rail portions 50 and 52 which are disposed at right angles to each other to form a miter corner. Each of the rail portions 50 and 52 is of a cross section identical to the rail portion 34 in that they include a wooden support portion 35' and a resilient cushion 24' covered by felt material 26'. The rail portions 50 and 52 are held in angular relationship to each other by a support bracket 54 which as viewed from the top, forms a right angle member having legs 56 and 58. The legs 56 and 58 are each provided with a pair of longitudinally extending slots 60 which receive screws 62 passing through the slots 60 and are embedded in the wooden support portion 35' of the rail portions 50 and 52.

Figure 6:
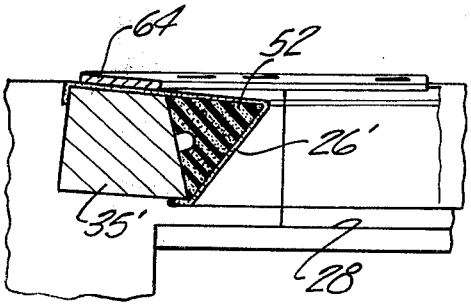
FIG. 6 is a cross-sectional view taken generally on line 6—6 in FIG. 5.
Figure 5:
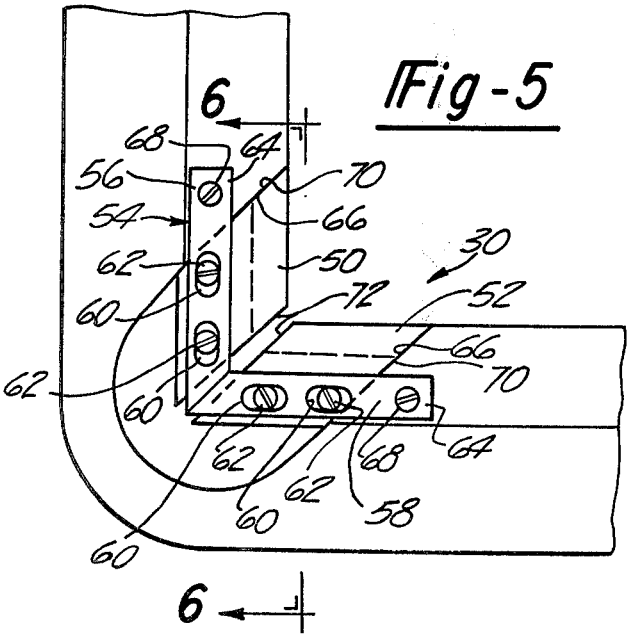
FIG. 5 is a top view of a pocket plug assembly embodying the invention associated with a corner pocket of a pocket billiard table.

The legs 56 and 58 of the bracket member 54 extend at right angles to each other and also are tilted transversely at an angle converging with the table top or playing surface 28 as seen in FIG. 6. The free end portions 64 of the legs 56 and 58 extend beyond the marginal edges 66 of the pockets 12 and are provided with openings for receiving screws 68. When a plug assembly 30 is in position in a corner pocket 12 the bracket 54 is supported from the top of the permanent rails 16 at opposite sides of the pocket 12 and the screws 68 pass through the openings into the wooden support portion 18 of the permanent rails 16 to support the plug assembly 30 in position. The slots 60 and screws 62 make it possible to adjust the rail portions 50 and 52 longitudinally relative to the adjacent permanent rails 16 so that their angular outer ends 70 tightly abut the edges 66 at the ends of the permanent rails. This leaves a gap between angular inner ends 72 of rail portions 50 and 52 which is of no consequence since the size of the billiard balls is such that a ball striking the corner will contact both rail portions 50 and 52 at opposite sides of the gap. The plug assemblies 30 are supported from the top of the permanent rails 16 so that the ball engaging lips 29' of the rail portions 50 and 52 are maintained in alignment with the lips 29 of the adjacent permanent rails 16.

The corner plug assemblies 30 are covered with cloth material 26' in the manner described in connection with the plug assemblies 32 for the side pockets 14. In other words, the cloth material 26' may be applied before the bracket 54 is attached to the rail portions 50 and 52 or in the alternative, the rail portions and bracket 54 may be fitted to the corner pocket 12 and after the screws 60 are firmly in place the assembly may be covered with cloth material 26' to conceal the bracket 54 and the screws 62.

To make an installation of plug elements 30 and 32 to a pocket billiard table for the first time, it is necessary simply to form the plug rail portions 34 to conform to the side pockets 14 after which holes may be drilled in the wood support portions in alignment with the holes in the bracket 40 to receive screws 46. Similarly, with the plug elements 30 in position relative to the end or corner pockets 12 holes are drilled in the wooden support portion 18 of the permanent rail 16 to receive the screws 68.

Figure 7:
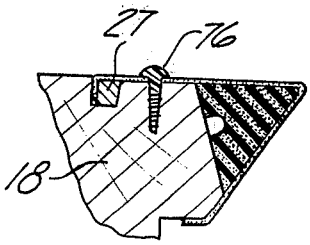
FIG. 7 is a cross-sectional view similar to FIG. 2 showing the positioning of a screw plug element after the pocket plug assembly has been removed.

When the plug elements or assemblies 30 and 32 are to be removed to convert the carom billiard table to a pocket billiard table, the screws 46 and 68 are removed to permit removal of the plug assemblies 30 and 32. Thereafter, the exposed holes may, if desired, be covered with a hole plug element 76, as seen in FIG. 7, having a color to conform to the color of the felt material 26 covering the table surface and rail portions.

The permanent rails 16 of a pocket billiard table are conventionally installed so that the top surface of the support portion 18 and its attached cushion portion 24 is disposed at an angle of approximately 5° to the playing surface 28 of the table. However, this angle varies a few degrees between tables made by different manufacturers. The present plug assemblies 30 and 32 readily adapt themselves to any differential in the angle of the permanent rails 16 and position the plugs in the pockets 12 and 14 so that the ball engaging lips 29' are in alignment with the ball engaging lip 29 of the permanent rails 16. In the case of the plug assembly 30, this is readily achieved since the bracket member 40 automatically assumes the same angle as the upper surface of the permanent rails. In the case of the plug assembly 30 for the corner pockets 12, the legs 56 and 58 may be bent, slightly, to accommodate any variation in angle from the usual standard of approximately 5°.

Figure 8:
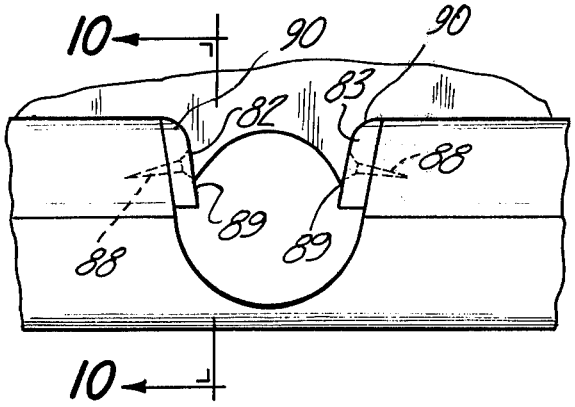
FIG. 8 is a view similar to FIG. 3 of plug assemblies installed in a side pocket of a pocket billiard table for the play of snooker.
Figure 9:
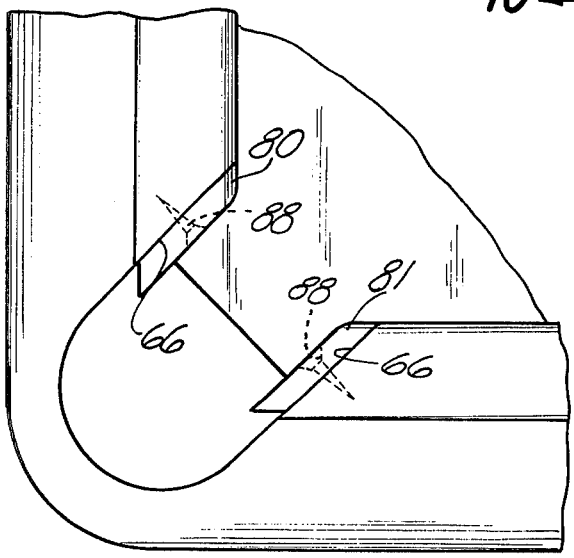
FIG. 9 is a top view of a plug arrangement employed to modify the corner pocket of a pocket billiard table for the play of snooker.

Referring now to FIGS. 8 and 9, a pair of plug assemblies 80 and 81 are employed for converting the corner pockets 12 of a pocket billiard table to a snooker table, and a pair of plug assemblies 82 and 83 are used to convert the side pockets 14 to smaller pockets for the play of snooker. In the game called snooker, the balls are slightly smaller than the balls used in conventional pocket billiards but the openings the pockets are very much smaller in proportion to the diameter of the ball than they are on a conventional pocket billiard table.

Figure 10:
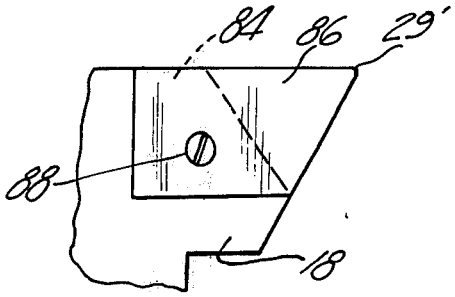
FIG. 10 is a cross-sectional view taken on line 10—10 in FIG. 8.

Referring first to one of the plug assemblies 82 used in association with the side pockets 14, as shown in FIG. 8, the plug assembly 82 is formed of a cross section indentical to the cross section of the rail portions 34 and 50 and 52, with a support portion 84 and a cushion portion 86, as seen in FIG. 10 corresponding to the support portions 35 and cushion portions 24'. The plug assembly 82 to covered with a felt cloth material 26' after which it is held in position relative to the permanent rails 16 with the lip 29' in alignment with the lip 29. A hole is formed in the support portion 18 of the permanent rail 16 for receiving a wood screw 88 which extends perpendicular to the surface 89 and serves to hold the plug assembly 82 in position. A plug assembly 83 also is required for each side pocket 14 which is substantially identical to the plug assembly 82 but is a mirror image thereof. The plug assemblies 82 and 83 are used at opposite sides of the pocket and for the play of snooker, the corners of the plug assemblies 82 and 83 have a rounded configuration as indicated at 90 in FIG. 8.

The plug assemblies 80 and 81 used in association with the corner pockets 12 are formed similarly to the plug assemblies 82 and 83 except that they are formed at a greater angle than the side pocket plug assemblies. The plug assemblies 80 and 81 are held in position to the permanent rail 16 of the billiard table in the same manner, namely by employing a screw 88 passing generally perpendicular to the ends 66 of the permanent rail 16 and being embedded in its wood support portion 18.

Pocket plug assemblies for converting a pocket billiard table to a carom billiard table or to a snooker table have been provided in which the plug assemblies may be readily made to conform to the shape of the pockets and in which the plug assemblies are supported relative to the permanent rail portions of the pocket billiard table so that lip engaging portions are maintained in alignment with each other and so that the impact of a ball striking a plug assembly is transmitted to the permanent rail portions of the table to afford the same impact characteristics as would be obtained with a permanent rail installation.

The embodiments of the invention in which an exclusive property or privilege is claimed are defined as follows:

1. A pocket plug for use with a pocket billiard table having permanent rail assemblies with a solid support portion and a resilient cushion portion at the perimeter and above the top of the table interrupted by ball receiving pockets, said pocket plug comprising, a rail subassembly having a solid support portion and a resilient cushion portion mounted on said solid support portion, said plug being adapted to be disposed in a pocket of said table with an end in abutment with the permanent rail assembly adjacent to the pocket, and means including a bracket member mounted on said solid support portion of said pocket plug and having parts projecting beyond the end thereof and being adapted for detachable connection to said permanent rail assembly to maintain said pocket plug in said pocket with said resilient cushion portion thereon in alignment with the resilient cushion portion of said permanent rail assembly, and fastening means associated with said bracket parts and adapted to releasably connect said bracket parts to said permanent rail assembly.

2. The combination of claim 1 in which said pocket plug has opposite end portions adapted to engage opposite sides of a ball receiving pocket and in which said bracket member is mounted on a top surface of said plug and presents portions projecting beyond the ends of said plug, said portions being adapted for engagement with a top surface of the permanent rails to support said plug in said pocket and in elevated position above the top of said table.

3. A pocket plug for use with a pocket billiard table having permanent rail assemblies with a solid support portion and a resilient cushion portion at the perimeter and above the top of the table interrupted by ball receiving pockets, said pocket plug comprising, a rail subassembly having a solid support portion and a resilient cushion portion mounted on said solid support portion, said plug being adapted to be disposed in a pocket of said table with an end in abutment with the permanent rail assembly adjacent to the pocket, and means including a bracket member mounted on said solid support portion of said pocket plug and projecting beyond the end thereof and being adapted to detachably engage said permanent rail assembly to maintain said pocket plug in said pocket with said cushion portion of said permanent rail assembly, and fastening means associated with said bracket member and adapted to releasably connect said bracket member to said permanent rail assembly, said plug having a vertical dimension less than the vertical dimension of said permanent rail assemblies.

4. A pocket plug for use with a pocket billiard table having permanent rail assemblies with a solid support portion and a resilient cushion portion at the perimeter and above the top of the table interrupted by ball receiving pockets, said pocket plug comprising, a rail subassembly having a solid support portion and a resilient cushion portion mounted on said solid support portion, said plug having a vertical dimension less than the vertical dimension of said permanent rail assemblies and being adapted to be disposed in a pocket of said table with an end in abutment with the permanent rail assembly adjacent to the pocket, means operatively associated with said solid support portion of said pocket plug and a solid support of said permanent rail assembly to maintain said pocket plug in said pocket with said resilient cushion portion thereof in alignment with the resilient cushion of said permanent rail assembly, said means including a screw fastener releasably connecting said solid support portions of said permanent rail assemblies and said plug to each other with the latter in elevated relationship to the top of said table.

* * * * *